United States Patent [19]

Saeki et al.

[11] Patent Number: 4,876,233

[45] Date of Patent: Oct. 24, 1989

[54] RECORDING MATERIAL

[75] Inventors: Keiso Saeki; Shojiro Sano; Katsumi Matsuoka; Masanobu Takashima; Ken Iwakura, all of Shizuoka, Japan

[73] Assignee: Fuji Photo Film Co., Ltd., Kanagawa, Japan

[21] Appl. No.: 287,524

[22] Filed: Dec. 15, 1988

Related U.S. Application Data

[63] Continuation-in-part of Ser. No. 158,468, Feb. 22, 1988, abandoned.

[30] Foreign Application Priority Data

Feb. 20, 1987 [JP] Japan ..... 62-37404
Mar. 13, 1987 [JP] Japan ..... 62-58514

[51] Int. Cl.[4] ..... B41M 5/16; B41M 5/18

[52] U.S. Cl. ..... 503/209; 427/150; 428/913; 428/914; 503/211; 503/215; 503/225

[58] Field of Search ..... 427/150–152; 428/913, 914; 503/208–212, 215–217, 225

[56] References Cited

U.S. PATENT DOCUMENTS 4,262,938 4/1981 Yamaguchi et al. ..... 503/211
4,520,376 5/1985 Morishita et al. ..... 503/215

FOREIGN PATENT DOCUMENTS 55-128489 10/1980 Japan ..... 503/209
0021294 2/1985 Japan ..... 503/211

*Primary Examiner*—Bruce H. Hess
*Attorney, Agent, or Firm*—Sughrue, Mion, Zinn, Macpeak & Seas

[57] ABSTRACT

A recording material comprising a support provided thereon a color developer and microcapsules containing a substantially colorless color former is disclosed, wherein the microcapsules further contains at least one of nickel compounds represented by formulae (I) and (II) shown in the specification. The microcapsules exhibit excellent light-resistance, and a color image developed exhibits excellent light-fastness.

10 Claims, No Drawings

RECORDING MATERIAL

This is a continuation-in-part of application Ser. No. 07/158,468 filed 2/22/88 now abandoned.

FIELD OF THE INVENTION

This invention relates to a recording material, and more particularly to a recording material utilizing a color formation reaction between a substantially colorless color former and an electron accepting compound.

BACKGROUND OF THE INVENTION

Pressure-sensitive recording materials are generally composed of an upper sheet comprising a support having provided thereon a microcapsule layer containing microcapsules prepared by dissolving a substantially colorless color former in an appropriate solvent and encapsulating oil droplets of the solution; a lower sheet comprising a support having provided thereon a color developer layer containing an electron accepting compound (hereinafter referred to as color developer); and, if desired, an intermediate sheet comprising a support having provided on one side thereof a microcapsule layer and on the other side thereof a color developer layer.

Another type of pressure-sensitive recording material comprises a support having provided thereon a recording layer containing both the aforesaid microcapsules and a color developer.

In still another type, either the aforesaid microcapsules or the color developer may be incorporated into a support, with the other being coated thereon. The details for these pressure-sensitive recording materials are described, e.g., in U.S. Pat. Nos. 2,505,470, 2,505,489, 2,550,471, 2,730,457, and 3,418,250.

The conventional pressure-sensitive recording materials suffer from serious disadvantages in that the microcapsule layer containing a color former has insufficient light-resistance and the color developed has insufficient fastness to light. That is, the color developability of the recording material is reduced by exposure of the microcapsule layer to light, and the color density obtained with the color developer is reduced due to light exposure.

It has been proposed to use hydrated quinoline derivatives, p-phenylenediamine derivatives, and the like in an attempt to improve light-fastness of the color image formed on a pressure-sensitive recording material. However, the effectiveness in improving the light-fastness of the color image attained by these compounds proved unsatisfactory. Besides, these compunds are virtually ineffective to improve the light-resistance of the microcapsule layer.

SUMMARY OF THE INVENTION

One object of this invention is to provide a recording material whose color former-containing microcapsule layer exhibits markedly improved light-resistance and which provides a color image having markedly improved light-fastness.

It has been found that the above object of this invention can be accomplished by a recording material comprising a support provided thereon a color developer and microcapsules containing a substantially colorless color former, in which said microcapsules further contain at least one of nickel compounds represented by formulae (I) and (II) shown below.

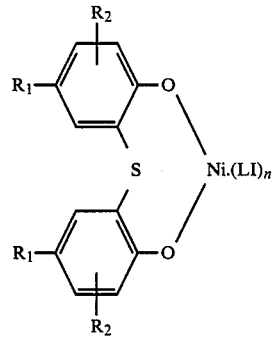

(I)

wherein $R_1$ and $R_2$ each represent a hydrogen atom, an alkyl group, an alkoxy group, an aryloxy group, an aryl group, a halogen atom, a cyano group or a nitro group; LI represents an organic ligand which is bonded to the nickel ion via a hetero atom to form a complex; and n represents 0, 1 or 2,

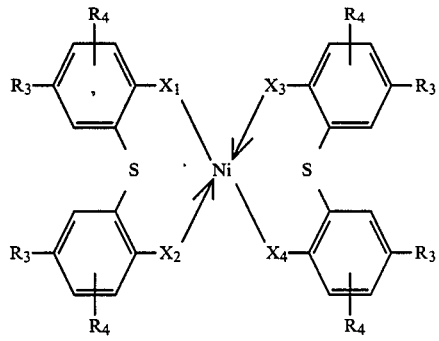

(II)

wherein $R_3$ and $R_4$ each represents a hydrogen atom, an alkyl group, an alkoxy group, an aryloxy group, an aryl group or a halogen atom; $X_1$ and $X_4$ each represents an oxygen atom or a sulfur atom; and $X_2$ and $X_3$ each represents a hydroxyl group or a mercapto group.

DETAILED DESCRIPTION OF THE INVENTION

The nickel compounds represented by formulae (I) and (II) preferably have a solubility in toluene of 1 or more, and more preferably 5 or more, respectively. The term "solubility" as used herein means the weight in grams of a solute that can be dissolved in 100 g of a solvent.

The hetero atom in the organic ligand represented by LI in the compounds of formulae (I) and (II) suitably includes nitrogen, oxygen, sulfur, selenium and phosphorous atoms, with a nitrogen atom being preferred.

The ligand is preferably bonded to the nickel ion via a nitrogen atom or atoms in a mono-, bi-, or tridentate atomic group, such as a primary, secondary or tertiary amino group, a substituted or unsubstituted imino group, a nitro group, an oxyimino group, and a hydrazino group, to form a complex.

Suitable ligands containing a nitrogen atom include aliphatic, alicyclic, aromatic, araliphatic, and heterocyclic amines. Typical examples of the aliphatic, alicyclic and araliphatic nitrogen-containing ligands are alkylamines having from 1 to 18 carbon atoms, e.g., methylamine, ethylamine, n-propylamine, isopropylamine, n-butylamine, n-hexylamine, n-octylamine, isooctylamine, 1,4-butylenediamine, t-octylamine, n-decylamine, n-dodecylamine, octadecylamine, etc.; alicyclic amines, e.g., cyclopentylamine, cyclohexylamine, etc.; benzylamine, 4-methylbenzylamine, and α- or β-phenylethylamine, etc.

The secondary heterocyclic ligands containing a nitrogen atom as a hetero atom preferably include pyrrolidine, piperizine, pipecoline, morpholine, thiomorpholine, imidazoline, indoline, benzomorpholine, benzimidazoline, tetrahydroquinoline, 2,2,4-trimethyltetrahydroquinoline, and 2,2,4-trimethyldihydroquinoline.

The aromatic amines preferably include aniline; anilines having their nucleus substituted, e.g., 2-, 3- or 4-methylaniline, chloroaniline, methoxyaniline, dichloroaniline, etc.; N-alkyl- or N,N-dialkylanilines, e.g., N-methylaniline, n-ethylaniline, o-phenylenediamine, N,N-dimethylaniline, N,N-diethylaniline, etc.; diphenylamine, 4,4'-diaminodiphenyl ether, 4,4'-diaminodiphenyl sulfide, 4,4'-diaminodiphenylsulfone; 4,4'-diaminodiphenylalkanes, e.g., 4,4'-diaminodiphenylmethane, 4,4'-diaminodiphenylethane, etc.; and 4,4'-diaminoazobenzene.

The nitrogen-containing ligand may further include 5- or 6-membered aromatic hetero rings containing a nitrogen atom as a hetero atom, in which the hetero ring may be substituted with an alkyl group having from 1 to 18 carbon atoms, and preferably 1 to 4 carbon atoms, an alkoxy group having from 1 to 4 carbon atoms, a cyano group, a hydroxyl group, a vinyl group, a phenyl group, an acyl group having from 1 to 4 carbon atoms or an amino group, and/or the hetero ring may be condensed with a benzene nucleus which may be substituted with a halogen atom, an alkyl group having from 1 to 4 carbon atoms, an alkoxy group having from 1 to 4 carbon atoms, etc.

Specific examples of such aromatic heterocyclic ligands include pyrrole, 2,4-dimethylpyrrole, pyrrolidone, imidazole, 1-methylimidazole, 2-methylimidazole, 1-vinylimidazole, 2-phenylimidazole, pyrazole, 3,4-dimethyl-5-pyrazolone, triazole, pyridine, α-, β- or γ-picoline, lutidine, collidines, parvoline, conyrines, methoxypyridines, aminopyridines (e.g., 3-aminopyridine, 2,3-diaminopyridine, 2,6-diaminopyridine, etc.), 4-formylpyridine, 4-cyanopyridine, pyrimidine, pyrazines, triazine, melamine, guanamines, amidine, quinoline, 2-ethylquinoline, isoquinoline, quinardine, quinazoline, quinoxaline, phthalazine, cinnoline, indolidine, idoles (e.g., 2-methylindole, 2-phenylindole, etc.), benzimidazole, 2-methylbenzimidazole, 2-stearylbenzimidazole, 2-aminobenzimidazole, benzoxazole, benzothiazole, 2-thiobenzothiazole, 2-aminobenzothiazole, benzotriazole, carbazole, acridine, phenazine, antipyrine, diguanamine, guanidine, bipyridyl, 2,6-(di-2-pyridyl)-pyridine (terpyridyl), phenanthridine, phenanthroline, dipyridyl ketone, etc.

The ligand may furthermore include bi- to polydentate (bi- to polyfunctional) nitrogen-containing ligands, such as alkylenediamines (e.g., ethylenediamine, propylenediamine, etc.), phenylenediamines, dialkylenetriamines (e.g., diethylenetriamine, monoethylenemonopropylenetriamine, dipropylenetriamine, and N-alkyl derivatives thereof) and triaminoalkanes (e.g., α,β,γ-triaminopropane, α,β,γ-triaminobutane, α,γ-diamino-β-(aminoethyl)propane, etc.).

The plural nitrogen atoms bonded to the metal atom and the plural carbon atoms bonded to these nitrogen atoms may form one hetero ring or one heterocyclic ring system. Typical examples of such a bidentate nitrogen-containing ligand are piperazine, imidazoline, and diazobicyclo[2,2,2]octane.

Other compounds suited as nitrogen-containing ligand include hydrazines, e.g., hydrazine, alkylhydrazines having from 1 to 5 carbon atoms in the alkyl moiety thereof, arylhydrazines (e.g., phenylhydrazine, etc.), etc.; hydrazones, e.g., acetone hydrazone, acetophenone hydrazone, etc.; hydrazides, e.g., acethydrazide, benzhydrazide, etc.; hydroxylamine; amidines, e.g., formamidine, etc.; amides, e.g., formamide, dimethylformamide, tetramethylurea, acetamide, benzamide, etc.; and oximes, e.g., acetaldoxime, acetoxime, etc.

The ligand LI in the nickel complex compounds according to the present invention may be coordinated to the nickel ion via an oxygen atom, a sulfur atom or a phosphorous atom.

The organic ligands coordinating via an oxygen or sulfur atom preferably include carbonyl compounds, e.g., benzophenone, acetylacetone, pyrrone, etc.; amine oxide; phosphine oxides, e.g., triphenylphosphine oxide, etc.; urea; thiocarbonyl compound, e.g., thiourea; and substituted derivatives of these compounds, e.g., 4,4'-bis(dimethylamino)benzophenone (Michler's ketone), etc. Ligands containing a sulfur atom further include mercaptans, e.g., 2-mercaptobenzothiazole, etc.; and thiones, e.g., 1,3-dimethylimidazolin-2-thione, etc. Organic ligands coordinating to a metal atom via a phosphorous atom include phosphines, e.g., triphenylphosphine.

Specific examples of the compounds of formula (I) (Compound Nos. 1 to 15) and the compounds of formula (II) (Compound Nos. 15 to 24) are shown below for illustrative purposes only and should not be construed as limiting upon the scope of the present invention.

(1)

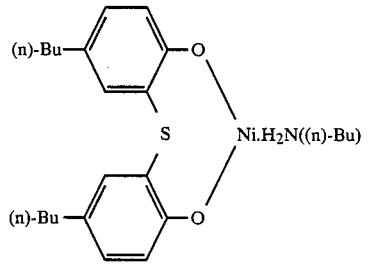

(2)

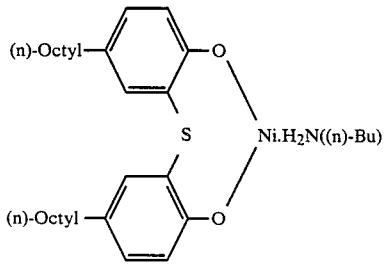

-continued
(3)
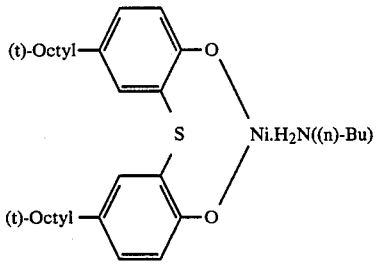
(4)
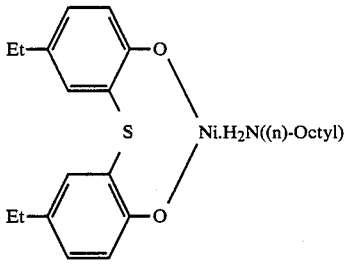
(5)
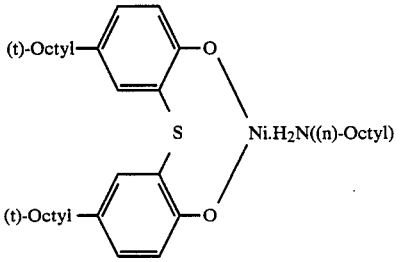
(6)
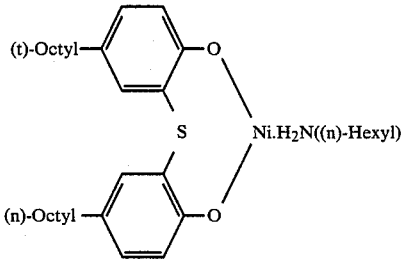
(7)
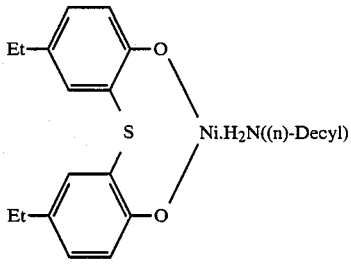
(8)
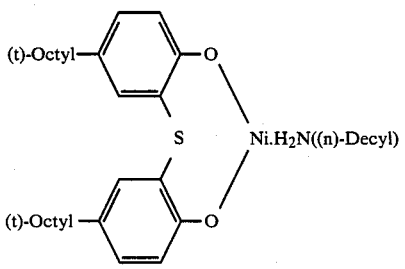
-continued
(9)
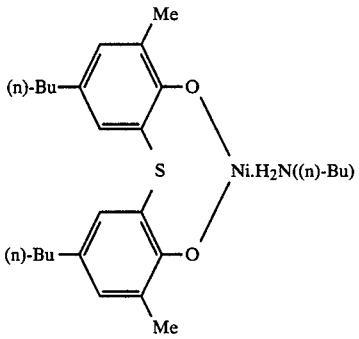
(10)
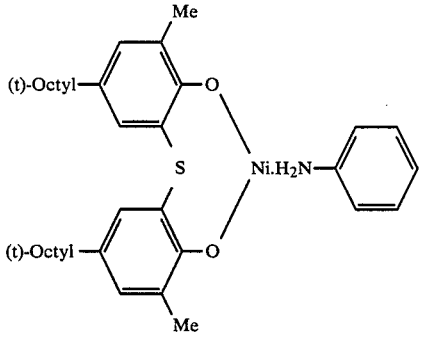
(11)
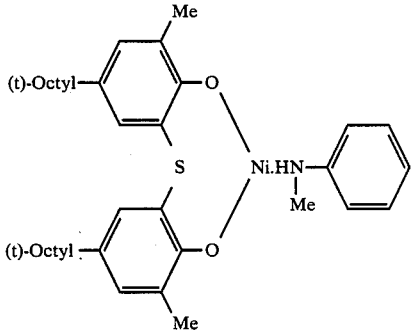
(12)
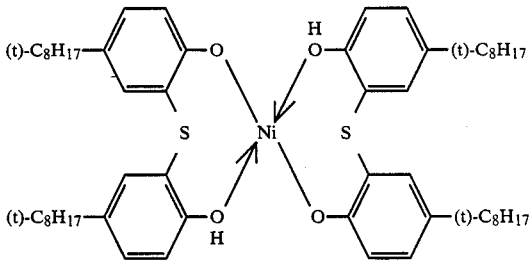
(13)
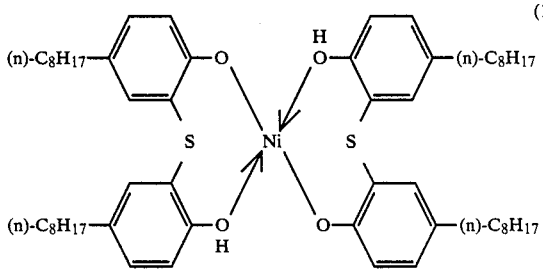

-continued (14)

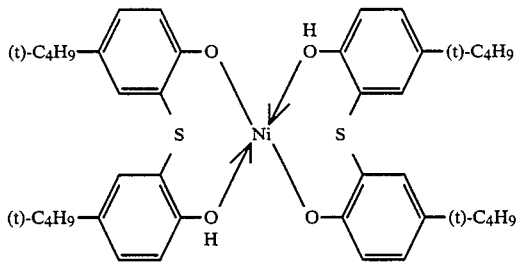

(15)

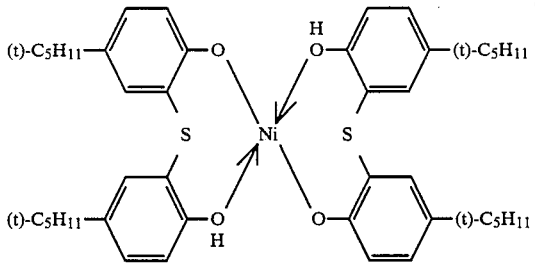

(16)

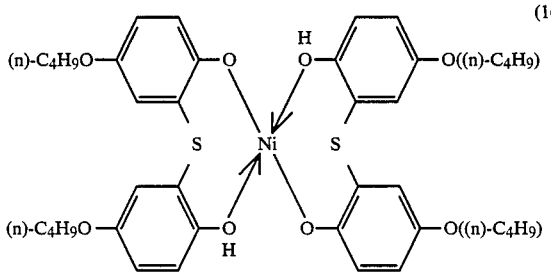

(17)

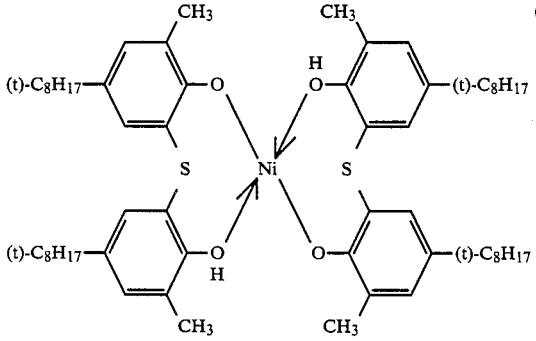

(18)

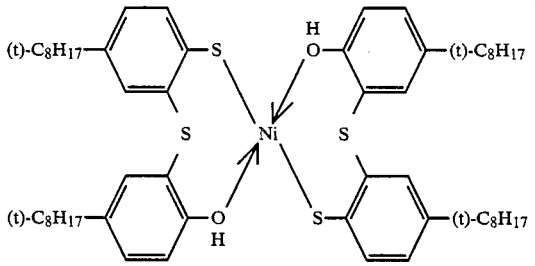

The nickel compounds according to the present invention are preferably used in an amount of from 5 to 200% by weight, and more preferably from 10 to 100% by weight, based on the amount of the color former used.

The color former which can be used in the present invention is not particularly restricted and includes triarylmethane compounds, diphenylmethane compounds, xanthene compounds, thiazine compounds, spiro compounds, indolyl (aza)phthalide compounds, leucoauramine compounds, rhodamine lactam compounds, triphenylmethane compounds, triazene compounds, spiropyran compounds, fluorene compounds, and the like.

Specific examples of the phthalide compounds are described, e.g., in U.S. Reissue Pat. No. 23,024, and U.S. Pat. Nos. 3,491,111, 3,491,112, 3,491,116, and 3,509,174. Specific examples of the fluoran compounds are described, e.g., in U.S. Pat. Nos. 3,624,107, 3,627,787, 3,641,011, 3,462,828, 3,681,390, 3,920,510, and 3,959,571. Specific examples of the spirodipyran compounds are described, e.g., in U.S. Pat. No. 3,971,808. Specific examples of pyridine and pyrazine compounds are described, e.g., in U.S. Pat. Nos. 3,775,424, 3,853,869, and 4,246,318. Specific examples of the fluorene compounds are described, e.g., in Japanese patent application (OPI) No. 159952/87 (the term "OPI" as used herein refers to a "published unexamined Japanese patent application").

Illustrative examples of these color formers are triarylmethane compounds, e.g., 3,3-bis(p-dimethylaminophenyl)-6-dimethylaminophthalide (i.e., Crystal Violet Lactone), 3,3-bis(p-dimethylaminophenyl)phthalide, 3-(2-ethoxy-4-diethylaminophenyl)-3-(1-ethyl-2-methylindol-3-yl)phthalide, 3-(2-ethoxy-4-diethylaminophenyl)-3-(1-octyl-2-methylindol-3-yl)phthalide, 3-(2-ethoxy-4-diethylaminophenyl)-3-(1-octyl-2-methylindol-3-yl)-4- or -7-azaphthalide, 3-(2-ethoxy-4-diethylaminophenyl)-3-(1-octylindol-3-yl)-4-or -7-azaphthalide, 3,3'-[oxybis(2,1-ethanediyloxy(4-(diethylamino)-2,1-phenylene))]-bis-[3-[(2-methyl-1-octyl-)indol-3-yl]-1-(3H)-isobenzofuranone], 3-(2-ethoxy-4-diethylaminophenyl)-3-(1-ethyl-2-methylindol-3-yl)-4- or -7-azaphthalide, etc.; diphenylmethane compounds, e.g., 4,4'-bis-dimethylaminobenzhydrin benzyl ether, an N-halophenyl-leucoauramine, N-2,4,5-trichlorophenyl-leucoauramine, etc.; xanthene compounds, e.g., Rhodamine-B anilinolactam, Rhodamine (p-nitrilino)lactam, Rhodamine-B (p-chloroanilino)lactam, 2-(benzylamino)-6-diethylaminofluoran, 2-anilino-6-diethylaminofluoran, 2-anilino-3-methyl-6-diethylaminofluoran, 2-anilino-3-methyl-6-N-cyclohexylmethylaminofluoran, 2-o-chloroanilino-6-diethylaminofluoran, 2-(m-chloroanilino-6-diethylaminofluoran, 2-(3,4-dichloroanilino)-6-diethylaminofluoran, 2-octylamino-6-diethylaminofluoran, 2-dihexylamino-6-diethylaminofluoran, 2-m-trifluoromethylanilino-6-diethylaminofluoran, 2-butylamino-3-chloro-6-diethylaminofluoran, 2-ethoxyethylamino-3-chloro-6-diethylaminofluoran, 2-p-chloroanilino-3-methyl-6-dibutylaminofluoran, 2-anilino-3-methyl-6-dioctylaminofluoran, 2-anilino-3-chloro-6-diethylaminofluoran, 2-diphenylamino-6-diethylaminofluoran, 2-anilino-3-methyl-6-diphenylaminofluoran, 2-phenyl-6-diethylaminofluoran, 2-anilino-3-methyl-6-N-ethyl-N-isoamylaminofluoran, 2-anilino-3-methyl-5-chloro-6-diethylaminofluoran, 2-anilino-3-methyl-6-diethylamino-7-methylfluoran, 2-anilino-3-methoxy-6-dibutylaminofluoran, 2-o-chloroanilino-6-dibutylaminofluoran, 2-p-chloroanilino-3-ethoxy-6-N-ethyl-N-isoamylaminofluoran, 2-o-chloroanilino-6-p-butylanilinofluoran, 2-anilino-3-pentadecyl-6-diethylaminofluoran, 2-anilino-3-ethyl-6-dibutylaminofluoran, 2-anilino-3-methyl-4',5'-dichlorofluoran, 2-o-toluidino-3-methyl-6-diisopropylamino-4',5'-dimethylaminofluoran, 2-anilino-3-ethyl-6-N-ethyl-N-isoamylaminofluoran, 2-anilino-3-methyl-6-N-ethyl-N-γ-methoxypropylaminofluoran, 2-anilino-3-chloro-6-N-ethyl-N-isoamylaminofluran, 3,6-bis(diphenylamino)-fluoran, etc.; thiazine compounds, e.g., Benzoyl-leucomethylene Blue, p-nitrobenzoyl Leucomethylene Blue, etc.; and spiro compounds, e.g., 3-methyl-spiro-dinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)-spiro-pyran, 3-propyl-spiro-dibenzopyran, etc.

The above-described color formers may be used either individually or in combinations of two or more thereof.

The color formers are dissolved in a solvent and the color former solution is encapsulated to prepare a microcapsule dispersion for coating.

The solvent to be used for encapsulation includes natural oils, synthetic oils, and mixtures thereof. Specific examples of solvents are cotton seed oil, kerosene, paraffin, naphthenic oil, alkylated biphenyls, alkylated terphenyls, chlorinated paraffin, alkylated naphthalenes, diphenylalkanes, etc.

Methods for preparing color former-containing microcapsules include an interfacial polymerization method, an internal polymerization method, a phase separation method, an external polymerization method, a coacervation method, and the like.

In the preparation of a coating composition containing color former-containing microcapsules, a water-soluble binder or a latex type binder is generally used. The coating composition may further contain a capsule protecting agent, such as a cellulose powder, starch particles, talc, etc.

The nickel compounds of the present invention may be dissolved in a solvent either alone or together with the color former. The solution of the color former and/or the nickel compound may further contain various additives, such as ultraviolet absorbents, antioxidants, hindered phenol derivatives, hindered amine derivatives, nickel compounds other than those of the present invention, and so on.

The ultraviolet absorbents to be added preferably include those having a spectral absorption in the wavelength region between 270 nm and 380 nm. Examples of such ultraviolet absorbents are salicylic acid derivatives, e.g., phenyl salicylate, p-t-butylphenyl salicylate, p-octylphenyl salicylate, etc.; benzophenone compounds, e.g., 2,4-dihydroxybenzophenone, 2-hydroxy-4-methoxybenzophenone, 2-hydroxy-4-octoxybenzophenone, 2-hydroxy-4-dodecyloxybenzophenone, 2,2'-dihydroxy-4-methoxybenzophenone, 2,2'-dihydroxy-4,4'-dimethoxybenzophenone, 2-hydroxy-4-methoxy-5-sulfobenzophenone, etc.; benzotriazole compounds, e.g., 2-(2'-hydroxy-5'-methylphenyl)benzotriazole, 2-(2'-hydroxy-5'-t-butylphenyl)benzotriazole, 2-(2'-hydroxy-3', 5'-t-butylphenyl)benzotriazole, 2-(2'-hydroxy-3'-t-butyl-5'-methylphenyl)-5-chlorobenzotriazole, 2-(2'-hydroxy-3',5'-di-t-butylphenyl)-5-chlorobenzotriazole, 2-(2'-hydroxy-3',5'-di-t-amylphenyl)benzotriazole, 2-(2'-hyroxy-4'-octoxyphenyl)-benzotriazole, etc.; and cyanoacrylate compounds, e.g., 2-ethylhexyl-2-cyano-3,3'-diphenyl acrylate, ethyl-2-cyano-3,3'-diphenyl acrylate, etc. Of these, preferred are benzotriazole ultraviolet absorbents.

The hindered phenol derivatives to be added preferably include those where at least one of the 2- and 6-positions thereof is substituted with a branched alkyl group, such as 1,1-bis(2-methyl-4-hydroxy-5-t-butylphenyl)butane, 1,1,3-tris(3-methyl-4-hydroxy-5-t-butylphenyl)butane, bis(2-hydroxy-3-t-butyl-5-methylphenyl)methane, bis(2-methyl-4-hydroxy-5-t-butylphenyl)sulfide, etc.

The hindered amines to be added include the following compounds.

(i)

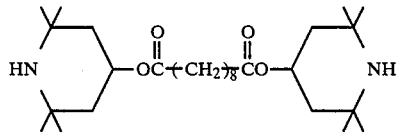

(ii)

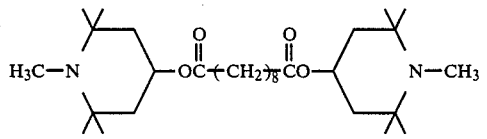

(iii)

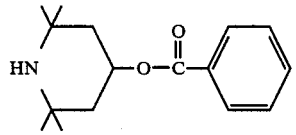

(iv)

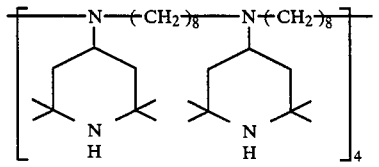

-continued
(v)
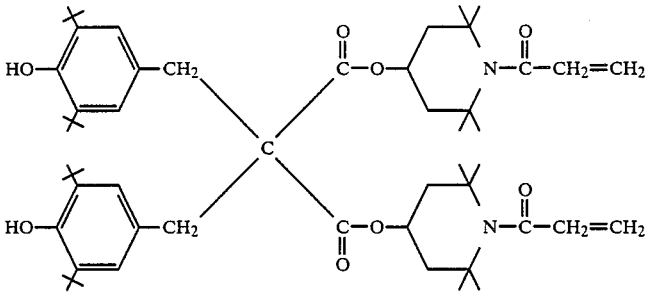
(vi)
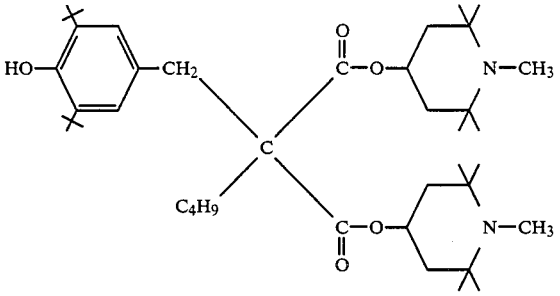
(vii)
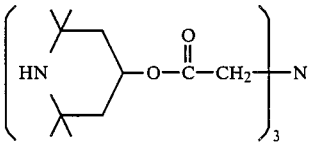
(viii)
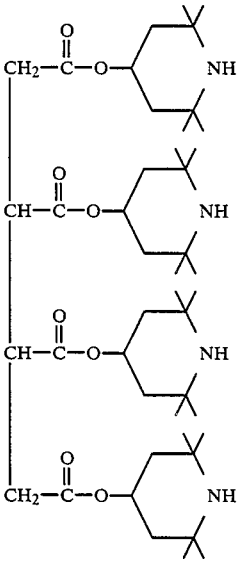
(ix)
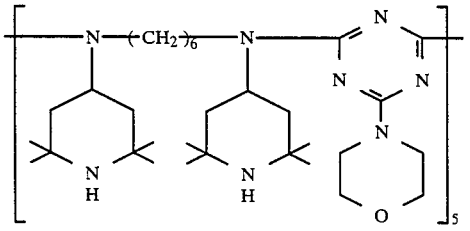

-continued (x)

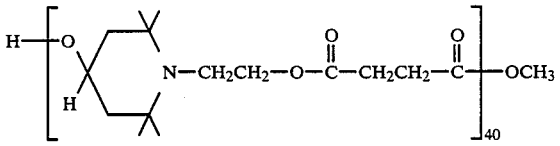

(xi)

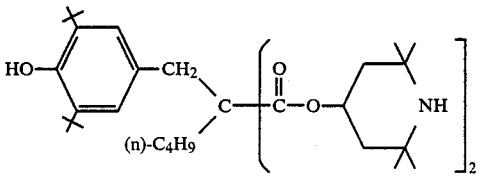

(xii)

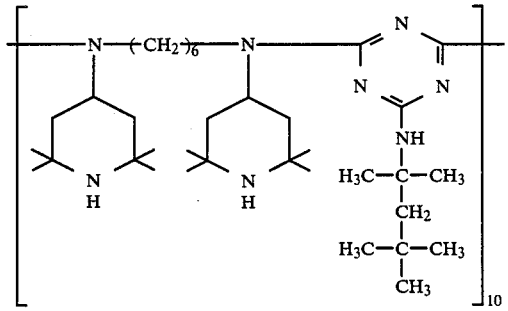

The nickel compounds which can be used in combination with the compounds of formulae (I) and (II) according to the present invention include chelates of nickel with bisdithio-α-diketone, acetylacetone, salicylaldehydroxime, thiobisphenol, aliphatic carboxylic acids, aliphatic sulfonic acids, aromatic carboxylic acids, and the like. Specific examples of these nickel chelates are Ni (II) dithiobenzyl, Ni (II) dithiobiacetyl, Ni (II) acetylacetonate, Ni (II) o-(N-isopropylformamidoyl)phenol, Ni (II) o-(N-dodecylformimidoyl)-phenol, Ni (II) 2,2'-[ethylenebis(nitrilomethylidyne)]diphenol, Ni (II) salicylaldehyde phenylhydrazone, Ni (II) 2-ethylhexylcarboxylate, etc.

Among the aforesaid various additives, the ultraviolet absorbents are preferred. The total amount of these additives to be added preferably ranges from 5 to 200% by weight, and more preferably from 10 to 100% by weight, based on a color former.

The recording materials containing color former-containing microcapsules to which the present invention is applicable include pressure-sensitive recording materials, heat-sensitive recording materials, and the like.

The pressure-sensitive recording materials to which the present invention is applied embrace various embodiments of form as described, e.g., in U.S. Pat. Nos. 2,505,470, 2,505,471, 2,505,489, 2,548,366, 2,712,507, 2,730,456, 2,730,457, 3,103,404, 3,418,250, and 4,010,038. The most commonly employed form of pressure-sensitive recording materials is composed of at least a pair of sheets, each of which separately contains a color former and a color developer, respectively.

Methods for encapsulating the color former include a method utilizing coacervation of a hydrophilic colloid sol as described in U.S. Pat. Nos. 2,800,457 and 2,800,458, an interfacial polymerization method as described in British Pat. Nos. 867,797, 950,443, 989,264, and 1,091,076, and the method disclosed in U.S. Pat. No. 3,103,404.

The heat-sensitive recording materials to which the present invention is applied include the form described in Japanese patent application (OPI) No. 244594/85 and U.S. Pat. No. 4,682,194. The most commonly employed form comprises a support having provided thereon a layer having dispersed therein both color former-containing microcapsules and a color developer.

The color developer which develops a color upon contact with the above-described color former preferably includes compounds represented by formulae (V) to (VIII) shown below:

(V)

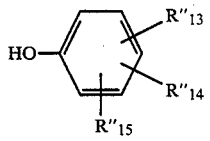

wherein $R''_{13}$ and $R''_{14}$, which may be the same or different, each represents a hydrogen atom, an alkyl group, an alkenyl group, an alkynyl group, an alkoxy group, an aryl group, an arylsulfonyl group, an alkoxycarbonyl group or a halogen atom; and $R''_{15}$ represents a hydrogen atom or a group represented by formula (c):

(c)

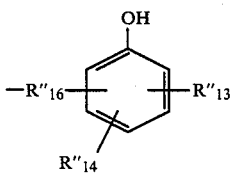

wherein $R''_{13}$ and $R''_{14}$ are as defined above; and $R''_{16}$ represents a divalent group having from 1 to 12 carbon atoms or $SO_2$.

Among the compounds of formula (V), preferred are those wherein $R''_{15}$ is a hydrogen atom, and $R''_{13}$ *and* $R''_{14}$ each is a hydrogen atom or an alkoxycarbonyl group and those wherein $R''_{15}$ is a group of formula (c); and $R''_{16}$ is an alkylene group having from 3 to 12 carbon atoms, a cycloalkylene group having from 5 to 7 carbon atoms, an aralkylene group having from 8 to 12 carbon atoms or $SO_2$.

In formulae (V) and (c), the terms "alkyl group", "alkenyl group" and "alkynyl group" mean an acylic or cyclic alkyl, alkenyl and alkynyl group, respectively, which may be unsubstituted or substituted with an aryl group, an alkoxy group, an aryloxy group, a halogen atom, a cyano group, etc.

Illustrative examples of the color developers represented by formula (V) are 4-phenylphenol, bisphenolsulfone, p-phenylsulfonylphenol, p-tolylsulfonylphenol, bis(3-vinyl-4-hydroxyphenyl)sulfone, 2,2-bis(3-vinyl-4-hydroxyphenyl)propane, bis-3-allyl-4-hydroxyphenylsulfone, hexyl 4-hydroxybenzoate, 2,2'-dihydroxybiphenyl, 4-t-butylphenol, 4-t-octylphenol, 4-chlorophenylphenol, 2-bis(4-hydroxyphenyl)propane, 4,4'-isopyridenebis(2-methylphenol), 1,1-bis(3-chloro-4-hydroxyphenyl)cyclohexane, 1,1-bis(3-chloro-4-hydroxyphenyl)-2-ethylbutane, 4,4'-sec-isooctylidenediphenol, 4,4'-sec-butylidenediphenol, 4-p-methylphenylphenol, 4,4'-isopentylidenediphenol, 4,4'-methylcyclohexylidenediphenol, 4,4'-dihydroxydiphenyl sulfide, 1,4-(4'-hydroxycumyl)benzene, 1,3-(4'-hydroxycumyl)benzene, 4,4'-thiobis(6-t-butyl-3-methylphenol), 4,4'-dihydroxydiphenylsulfone, hydroquinone monobenzyl ether, 4-hydroxybenzophenone, 2,4-dihydroxybenzophenone, polyvinylbenzyloxycarbonylphenol, 2,4,4'-trihydroxybenzophenone, trihydroxybenzophenone, 2,2',4,4'-tetrahydroxybenzophenone, dimethyl 4-hydroxyphthalate, methyl 4-hydroxybenzoate, 2,4,4'-trihydroxydiphenylsulfone, 1,5-bis-p-hydroxyphenylpentane, 1,6-bis-p-hydroxyphenoxyhexane, tolyl 4-hydroxybenzoate, α-phenylbenzyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, benzyl 4-hydroxybenzoate, m-chlorobenzyl 4-hydroxybenzoate, β-phenethyl 4-hydroxybenzoate, 4-hydroxy-2',4'-dimethyldiphenylsulfone, β-phenethyl orsellinate, cinnamyl orsellinate, o-chlorophenoxyethyl orsellinate, o-ethylphenoxyethyl orsellinate, o-ethylphenoxyethyl orsellinate, m-phenylphenoxyethyl orsellinate, β-3'-t-butyl-4'-hydroxyphenoxyethyl 2,4-dihydroxybenzoate, 1-t-butyl-4-p-hydroxyphenylsulfonyloxybenzene, 4-N-benzylsulfamoylphenol, p-methylbenzyl 2,4-dihydroxybenzoate, β-phenoxyethyl 2,4-dihydroxybenzoate, benzyl 2,4-dihydroxy-6-methylbenzoate, methyl bis-4-hydroxyphenylacetate, β-phenoxybutyl p-hydroxybenzoate, δ-phenoxybutyl p-hydroxybenzoate, β-p-methoxyphenoxyethyl, 2,4,6-trihydroxybenzoate, β-p-butoxyphenoxyisopropyl p-hydroxybenzoate, β-p-methoxyphenoxyethoxyethyl 2,4-dihydroxybenzoate, phenoxybutyl orsellinate, p-methoxyphenoxyethyl β-resorcylate, β-p-methoxyphenoxyethoxyethyl orsellinate, β-o-methoxyphenoxyethyl orsellinate, tolyloxyethyl orsellinate, β-p-methoxyphenoxypropyl orsellinate, phenoxyethyl β-resorcylate, δ-p-methoxyphenoxybutyl β-resorcylate,

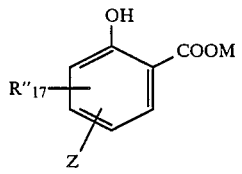

(VI)

wherein $R''_{17}$ represents a hydrogen atom, an aryl group, a heterocyclic aromatic group, a substituted amino group, an alkoxy group, an alkyl group, an alkenyl group, or an alkynyl group; Z represents an alkyl group, an alkenyl group, an alkynyl group, an alkoxy group or a halogen atom; and M represents a hydrogen atom or $M'^{1/l}$, wherein M' represents an l-valent matal atom and l represents an integer of from 1 to 3.

In formula (VI), the terms "alkyl group", "alkenyl group", and "alkynyl group" mean acylic or cyclic alkyl, alkenyl and alkynyl groups, respectively, which may be substituted with an aryl group, an alkoxy group, an aryloxy group, a cyano group, etc. The term "aryl group" may mean a phenyl group or a naphthyl group, and the aryl group and heterocyclic aromatic group may be unsubstituted or substituted with an alkyl group, an alkoxy group, an aryloxy group, a halogen atom, a nitro group, a cyano group, a substituted carbamoyl group, a substituted sulfamoyl group, a substituted amino group, a substituted oxycarbonyl group, a substituted oxysulfonyl group, a thioalkoxy group, an arylsulfonyl group, a phenyl group, etc.

$R''_{17}$ preferably represents a hydrogen atom, a phenyl group or an alkyl, alkenyl or alkynyl group having from 1 to 22 carbon atoms. Z preferably represents an alkyl, alkenyl or alkynyl group having from 1 to 22 carbon atoms, an alkoxy group having from 1 to 20 carbon atoms, a chlorine atom or a fluorine atom. M'preferably represents a zinc, aluminum, magnesium or calcium atom.

The substituents for the alkyl, alkenyl, alkynyl, or alkoxy group represented by Z preferably includes an aryl group having from 6 to 12 carbon atoms, an aryloxy group having from 6 to 16 carbon atoms, an alkoxy group having from 1 to 12 carbon atoms, a halogen atom, and an alkoxycarbonyl group. $R_{17}$ and Z may combine to form a naphthalene ring.

The salicylic acid derivatives represented by formula (VI) preferably contain at least 14, and more preferably at least 16, carbon atoms in total in view of nonaqueous solubility. These salicylic acid derivatives may be used either in the form of a free acid or a metal salt and may be dispersed in a dispersion medium in the presence of, for example, zinc oxide to form a salt in situ or to cause adsorption or double decomposition.

Specific examples of the compounds of formula (VI) are 4-pentadecylsalicylic acid, 3-phenylsalicylic acid, 3-cyclohexylsalicylic acid, 3,5-di-t-butylsalicylic acid, 3,5-di-dodecylsalicylic acid, 3-methyl-5-benzylsalicylic acid, 3-phenyl-5-(α,α-dimethylbenzyl)salicylic acid, 3,5-di(α-methylbenzyl)salicylic aciad, 3,5-di-t-octylsalicylic acid, 5-tetradecylsalicylic acid, 5-hexadecylsalicylic acid, 5-octadecylsalicylic acid, 5-α-(p-α-methylbenzylphenyl)ethylsalicylic acid, 4-dodecyloxysalicylic acid, 4-tetradecyloxysalicylic acid, 4-hexadecyloxysalicylic acid, 4-β-phenoxyethoxysalicylic acid, 4-β-p-tolyloxyethoxysalicylic acid, 4-β-p-ethylphenoxyethoxysalicylic acid, 4-β-p-methoxyphenoxyethoxysalicylic acid, 4-β-p-ethoxyphenoxyethoxysalicylic acid, 4-β-m-tolyloxyethoxysalicylic acid, 4-β-o-tolyloxyethoxysalicylic acid, 4-(8-phenoxyoctyloxy)salicylic acid, 3-xylyl-5-(α,α-dimethylbenzyl)salicylic acid, 2-hydroxy-1-α-ethylbenzyl-3-naphthoic acid, 3,5-dicyclopentadienylsalicylic acid, a carboxyl-modified terpenephenol resin, etc.

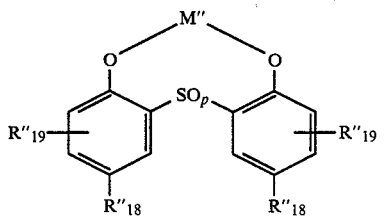

(VII)

wherein R''$_{18}$ represents a hydrogen atom, an aryl group, an alkyl group or a halogen atom; R''$_{19}$ represents a hydrogen atom, an alkyl group, an alkoxy group or a halogen atom; M'' represents a divalent metal atom; and p represents 0, 1 or 2.

Specific examples of the compounds of formula (VII) are zinc, nickel or magnesium salts of bis(2-hydroxy-5-butylphenyl)sulfone, bis(2-hydroxy-5-phenylphenyl)-sulfone, bis(2-hydroxy-5-octylphenyl)sulfone, bis(2-hydroxy-5-chlorophenyl)sulfone, bis(2-hydroxy-3-chloro-5-butylphenyl)sulfone, etc.

$$(R)_2Zn(A)_2 \qquad \text{(VIII)}$$

wherein R represents a monodentate or polydentate colorless organic ligand connected to an Zn ion via a hetero atom to form a complex; and A represents SCN, a chlorine atom or a benzoate anion having a nucleophilic group.

The colorless organic ligand represented by R preferably includes pyridine, imidazole, quinoline, benzothiazole, benzimidazole and antipyrine ligands, each of which may be substituted with an alkyl group, a cyano group, an alkoxy group, a phenyl group, an amino group, a formyl group, a vinyl group, etc.

Specific examples of the compounds of formula (VIII) are complexes of zinc rhodanide with imidazole, 2-phenyl-imidazole, picoline, pyridine, 2-benzylimidazole, benzimidazole, 2,3-dimethyl-1-phenyl-3-pyrazolin-5-one, 1-phenyl-2-methyl-3-benzyl-3-pyrazolin-5-one, 1-phenyl-2-methyl-3-(2-ethylhexyl)-3-pyrazolin-5-one, 1-phenyl-2-methyl-3-isopropyl-3-pyrazolin-5-one, 1-phenyl-2,3-dibenzyl-pyrazolin-5-one, 1-phenyl-2-benzyl-3-methylpyrazolin-5-one, etc.

In addition to the compounds represented by formulae (V) to (VIII), color developers which can be used in the present invention further include acetylacetone complexes of molybdic acid, ditolylthiourea, 4,4'-diacetyldiphenylthiourea, novolak resins, metal-treated novolak resins (e.g., novolak resins as described in German patent application (OLS) No. 2,235,491), p-phenylphenol-formaline resins, p-butylphenol-acetylene resins, inorganic acids, terra abla, active clay, attapulgite, colloidal silica, aluminum silicate, magnesium silicate, zinc silicate, tin silicate, zinc rhodanide, zinc chloride, iron stearate, cobalt naphthenate, nickel peroxide, ammonium nitrate, bentonite, oxalic acid, maleic acid, tartaric acid, citric acid, succinic acid, stearic acid, and the like. The above-described color devlopers may be used either individually or in combinations thereof.

The color developer is dispersed in a binder, such as a styrene-butadiene latex, and coated on a transparent or opaque support, such as paper, synthetic paper, etc.

The present invention is now illustrated in greater detail with reference to the following Examples, but it should be understood that the present invention is not deemed to be limited thereto. In these examples, all the parts and percents are by weight unless otherwise indicated.

A color developer sheet commonly used in these examples was prepared as follows.

Two parts of zinc oxide, 18 parts of calcium carbonate, and 4 parts of zinc 3,5-di-α-methylbenzylsalicylate were added to 70 parts of water, and the mixture was dispersed in an attritor for 30 minutes. To the dispersion were added 2.5 parts (solid basis) of a carboxyl-modified SBR (styrene-butadiene rubber) latex and 12 parts of a 10% aqueous solution of polyvinyl alcohol (PVA) (degree of saponification: 99% ; degree of polymerization: 1000), followed by uniformly stirring to prepare a coating composition. The composition was coated on paper having a basis weight of 50 g/m$^2$ with an air knife coater to a dry weight of 4 g/m$^2$ and dried to obtain a color developer sheet.

EXAMPLES 1 TO 2 AND COMPARATIVE EXAMPLES 1 TO 2

A color former solution prepared by dissolving 4 parts of each of color formers shown in Table 1 and 2 parts of each of nickel compounds shown in Table 1 in 100 parts of 1-phenyl-1-xylylethane was emulsified and dispersed in 100 parts of a 4.4% aqueous solution of a partial sodium salt of polyvinylbenzenesulfonic acid (average molecular weight: 500,000) adjusted to a pH of 4 to obtain an O/W emulsion having a mean particle size of 4.5 μm.

Separately, 6 parts of melamine, 11 parts of a 37% formaldehyde aqueous solution, and 83 parts of water were heated at 60° C. while stirring. Thirty minutes later, there was obtained a clear aqueous solution containing melamine, formaldehyde, and a melamine-formaldehyde initial condensate.

The resulting mixed aqueous solution was added to the above prepared emulsion. After the mixture was adjusted to a pH of 6.0 with a 20% acetic acid aqueous solution, the temperature was elevated up to 65° C. and kept at that temperature for 30 minutes to complete encapsulation.

To the resulting mixture were added 200 parts of a 20% aqueous solution of etherified starch, 47 parts of starch particles (mean particle size: 40 μm), and 10 parts of talc. Water was then added thereto so as to have a solid concentration of 20% to prepare a microcapsule dispersion.

The microcapsule dispersion was coated on paper having a basis weight of 40 g/m$^2$ with an air knife coater to a dry weight of 5 g/m$^2$ and dried to obtain a microcapsule sheet.

For comparison, a microcapsule sheet was prepared in the same manner as described in Examples, except for replacing the color former solution prepared by dissolving 4 parts of Crystal Violet Lactone in 100 parts of 1-phenyl-1-xylylethane.

(1) Light Resistance of Microcapsule Layer

The microcapsule layer of each of the above-obtained microcapsule sheets was irradiated with light for 4 hours in a fadeometer using a fluorescent lamp (33,000 lux). The irradiated microcapsule layer was brought into contact with the color developer sheet, and a load of 300 Kg/cm$^2$ was applied thereon to develop a color. After placing the samples in a dark place for 24 hours, a spectrophotometric curve of the developed color in the wavelength region between 380 nm and 780 nm was obtained by means of a Hitachi Color Analyzer Model 307 (manufactured by Hitachi Ltd.) to determine the density (D) at the absorption maximum.

As a control, the same procedure as above was repeated, except for using a non-irradiated microcapsule sheet, to determine the density (fresh density) Do at the absorption maximum.

Light-resistance of the microcapsule layer was evaluated by a light-resistance index obtained by dividing D by Do. The results obtained are shown in Table 1 below. The greater the light-resistance index, the higher the light-resistance exhibited by the microcapsule layer.

(2) Light-Fastness of Developed Color

Each of the microcapsule sheets as above-prepared was brought into contact with the color developer sheet, and a load of 300 Kg/cm$^2$ was applied thereon to cause color formation. After placing the samples in a dark place for 24 hours, a spectrophotometric curve of each sample in the wavelength region between 380 nm and 780 nm was obtained in the same manner as described above to determine the density (fresh density) Do at the absorption maximum.

The developed color image was irradiated with light for 4 hours in a xenon fadeometer ("FAL-25AX-HC Model" manufactured by Suga Shikenki), and the density (D') at the absorption maximum was determined from a spectrophotometric curve prepared in the same manner as above.

Light-fastness of the microcapsule layer was evaluated by a light-fastness index obtained by dividing D' by Do. The results obtained are shown in Table 1 below. The greater the light-fastness index, the higher the light-fastness exhibited by the microcapsule layer.

TABLE 1

| Run No. | Color Former | | Nickel Compound | D/Do | D'/Do |
|---|---|---|---|---|---|
| Example 1 | 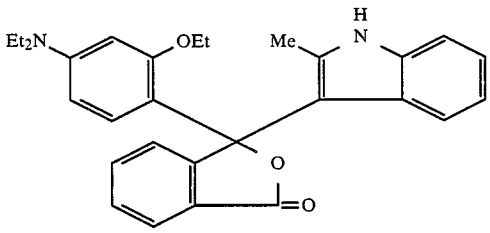 | 4 parts | Compound No. 3 | 0.78 | 0.7 |
| Example 2 | " | | Compound No. 5 | 0.80 | 0.75 |
| Example 3 | " | | Compound No. 15 | 0.79 | 0.76 |
| Example 4 | " | | Compound No. 17 | 0.80 | 0.77 |
| Example 5 | 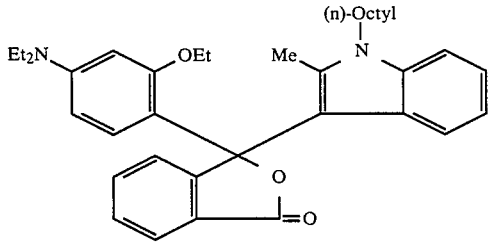 | 4 parts | Compound No. 6 | 0.85 | 0.83 |
| Example 6 | " | | Compound No. 10 | 0.80 | 0.77 |
| Example 7 | mixture of " 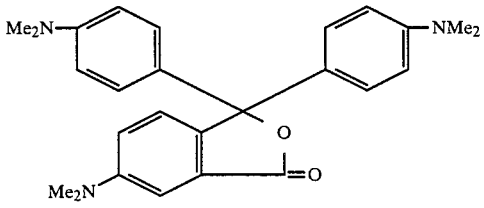 | (3 parts) and | Compound No. 3 | 0.75 | 0.72 |

TABLE 1-continued

| Run No. | Color Former | Nickel Compound | D/Do | D'/Do |
|---|---|---|---|---|
| | 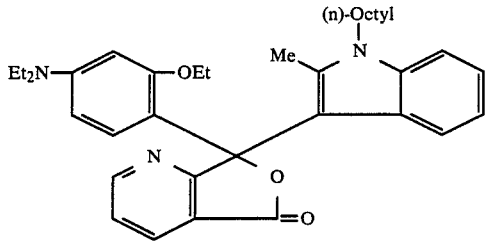 (1 part) | | | |
| Example 8 | " | Compound No. 8 | 0.77 | 0.74 |
| Example 9 | mixture of 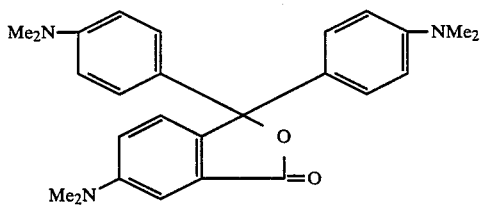 (3 parts) and 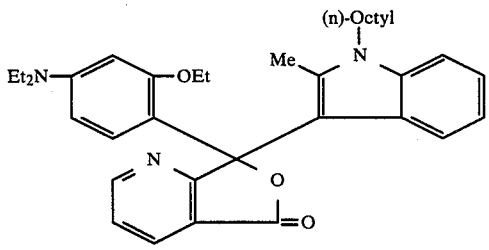 (1 part) | Compound No. 22 | 0.75 | 0.73 |
| Example 10 | 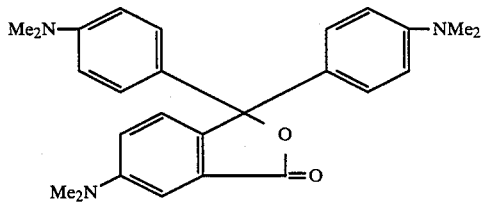 (4 parts) (Crystal Violet Lactone) | Compound No. 15 | 0.72 | 0.70 |
| Comparative Example 1 | " | None | 0.50 | 0.42 |
| Comparative Example 2 | 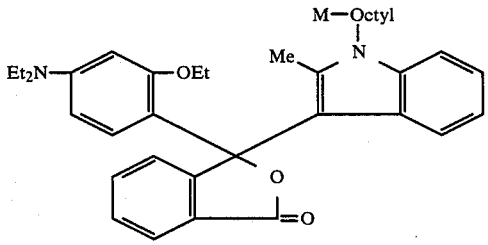 (4 parts) | None | 0.63 | 0.60 |

It can be seen from Table 1 that the microcapsule sheets containing the nickel compounds according to the present invention exhibit excellent light-fastness and develop a color image having excellent light-fastness.

While the invention has been described in detail and with reference to specific embodiments thereof, it will be apparent to one skilled in the art that various changes and modifications can be made therein without departing from the spirit and scope thereof.

What is claimed is:

1. A recording material comprising a support having provided thereon a color developer and microcapsules containing a substantially colorless color former, wherein said microcapsules further contain at least one of nickel compounds represented by formula (I)

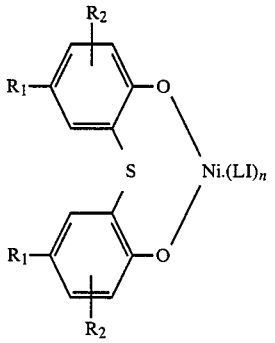

(I)

wherein $R_1$ and $R_2$ each represent a hydrogen atom, an alkyl group, an alkoxy group, an aryloxy group, an aryl group, a halogen atom, a cyano group or a nitro group; LI represents an organic ligand which is bonded to the nickel ion via a hetero atom to form a complex; and n represents 0, 1 or 2, and nickel compounds represented by formula (II)

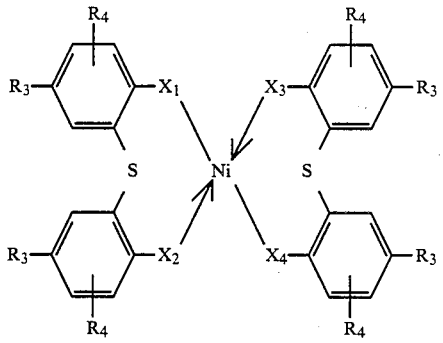

(II)

wherein $R_3$ and $R_4$ each represents a hydrogen atom, an alkyl group, an alkoxy group, an aryloxy group, an aryl group or a halogen atom; $X_1$ and $X_4$ each represents an oxygen atom or a sulfur atom; and $X_2$ and $X_3$ each represents a hydroxyl group or a mercapto group.

2. A recording material as in claim 1, wherein said nickel compounds represented by formula (I) and formula (II) have a solubility in toluene of 1 or more.

3. A recording material as in claim 1, wherein said nickel compounds represented by formula (I) and formula (II) have a solubility in toluene of 5 or more.

4. A recording material as in claim 1, wherein $R_1$ and $R_2$ each represents a hydrogen atom, an alkyl group having from 1 to 12 carbon atoms, an alkoxy group having from 1 to 10 carbon atoms, an aryloxy group having from 6 to 12 carbon atoms, a phenyl group or a chlorine atom.

5. A recording material as in claim 1, wherein $R_3$ and $R_4$ each represents a hydrogen atom, an alkyl group having from 1 to 12 carbon atoms, an alkoxy group having from 1 to 10 carbon atoms, an aryloxy group having from 6 to 12 carbon atoms, a phenyl group or a chlorine atom.

6. A recording material as in claim 1, wherein the hetero atom in the organic ligand is a nitrogen atom.

7. A recording material as in claim 1, wherein said nickel compound is present in a total amount of from 5 to 200% by weight based on the amount of the color former.

8. A recording material as in claim 1, wherein said nickel compound is present in a total amount of from 10 to 100% by weight based on the amount of the color former.

9. A recording material as in claim 1, wherein is used for a pressure-sensitive recording material.

10. A recording material as in claim 1, wherein is used for a heat-sensitive recording material.

* * * * *